US005536081A

United States Patent [19]

Pokhis

[11] Patent Number: 5,536,081

[45] Date of Patent: Jul. 16, 1996

[54] REFRIGERATOR WITH MATING INTERLEAVED SHELVES

[76] Inventor: Naum Pokhis, 1132 S. Doheny Dr. #303, Los Angeles, Calif. 90035

[21] Appl. No.: 306,307

[22] Filed: Sep. 15, 1994

[51] Int. Cl.[6] ..... E06B 1/00

[52] U.S. Cl. ..... 312/321.5; 312/405.1; 62/440

[58] Field of Search ..... 62/440, 441, 448, 62/449; 312/321.5, 404, 405.1, 408

[56] References Cited

U.S. PATENT DOCUMENTS 2,745,260 5/1956 Saunders ..... 312/321.5

FOREIGN PATENT DOCUMENTS 0683331 3/1964 Canada ..... 312/321.5

*Primary Examiner*—John M. Sollecito
*Attorney, Agent, or Firm*—Ilya Zborovsky

[57] ABSTRACT

A refrigerator comprises a main body having an inner chamber, a door moveable relative to the body between an open and a closed position, the main body having substantially horizontal main shelves, the door having substantially horizontal door shelves formed so that in a closed condition of the refrigerator the door shelves are turned into the main body, the door walls extending radially, the main shelves and the door shelves being provided with vertical walls which cooperate with one another so that the door shelves with the vertical walls.

8 Claims, 1 Drawing Sheet

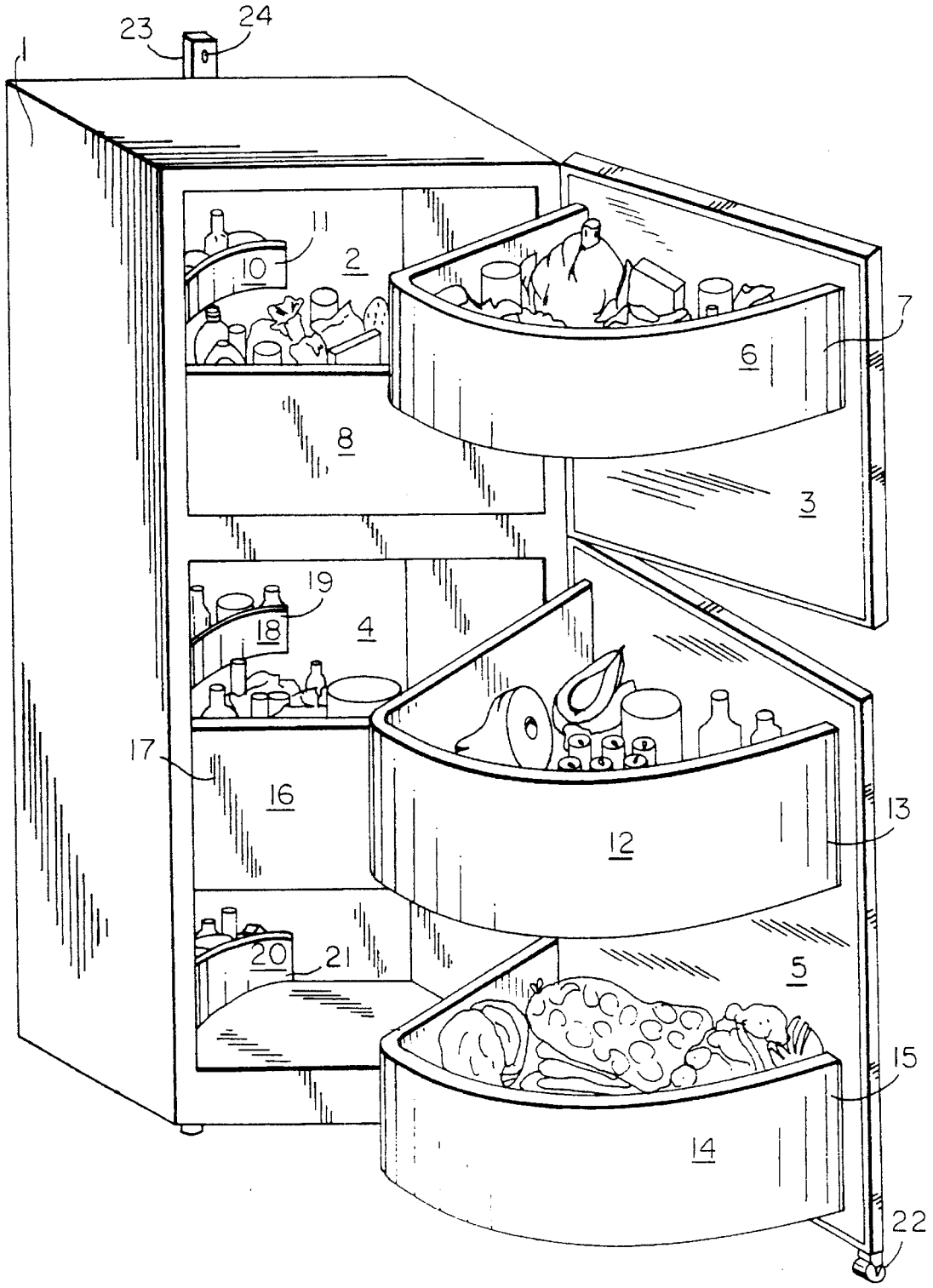
23
24
1
11
10
2
7
6
8
3
19
18
4
17
16
12
13
20
21
5
15
14
22

REFRIGERATOR WITH MATING INTERLEAVED SHELVES

BACKGROUND OF THE INVENTION

The present invention relates to refrigerators in general, and in particular to household refrigerators which have at least one or two doors on vertical hinges and with shelves provided inside the main body of the refrigerator and in the door as well.

In the known refrigerators a user has certain difficulties. Food products which are located near the door obstruct those food products which are located deeper and in order to remove them it is necessary to remove the food products located forwardly and then to put them in the initial order. It takes time and also causes loss of cooling energy when the door is opened. Also, in the existing refrigerators during the opening of the door the accumulated cold air immediately escapes, and the cooling unit must again cool the air. This causes additional expenditures of electrical energy, and a cooling agent, and also the mechanism is subjected to relatively fast wear. The change of the places of the food products also causes problems for elderly people and people who are restricted in their abilities to bend. The lower remote areas of the refrigerator therefore are frequently not used.

SUMMARY OF THE INVENTION

Accordingly, it is an object of the present invention to provide a refrigerator which eliminates the disadvantages of the prior art.

In keeping with these objects and with others which will become apparent hereinafter, one feature of the present invention resides, briefly stated, in a refrigerator which has a main body with an inner chamber and a door, wherein the inner chamber of the main body is provided with substantially horizontal main shelves, and the door is provided with substantially horizontal door shelves which in a closed condition of the door extend inwardly into the inner chamber of the refrigerator and after opening of the door are located outwardly of the inner chamber.

In accordance with another feature of the present invention, the door shelves are radial and have vertical walls, while in the inner chamber of the main body there are main horizontal shelves with vertical walls and small oval shelves in the corners of the inner chamber.

Since the doors of the refrigerator in accordance with the present invention are subjected to greater load and the opening angle can be more than 90° in order to take and place the food products a supporting wheel is arranged at the rear end of the door. Also, in the upper area of the main body a strap with a hole for fixing to a wall is provided.

When the door of the inventive refrigerator is opened, a user immediately sees the content of the refrigerator including its main body and the door, it can take the food products and place the food products without bending and taking the food products from the lower area and the deep area of the main body. Since the horizontal shelves are attached to the inner side of the door and have vertical walls, the cooled air only partially escapes from the refrigerator when the door is being opened, and the main portion of the cold is retained. Therefore the process of cooling is not interrupted, electrical and cooling agent are economized, and wear of the mechanism is lower.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawing is a perspective view of a refrigerator in accordance with the present invention with open upper and lower doors.

DESCRIPTION OF THE PREFERRED EMBODIMENT

The refrigerator in accordance with the present invention has a main body 1 having an upper freezing chamber 2 with a door 3 and a lower refrigerating chamber 4 with a door 5. A horizontal substantially radial shelf 6 is mounted on an inner side of the door 3 and has a vertical wall over its contour. The shelf 6 together with the wall 7 and a bottom form a chamber in which a cooled air is accumulated. The lower half of the freezing chamber is provided with a vertical wall 8 from the door side and together with the walls and the bottom forms a chamber in which also the cooled air is accumulated. For better use of the inner volume of the freezing chamber 2, a curved shelf 10 with a vertical wall 11 is arranged in the upper corner.

The refrigerating chamber 4 is formed substantially in the same way. At the top and at the bottom of the inner side of the door 5 two radial shelves 12 with walls 13 and a shelf 14 with a wall 15 are provided and together with a bottom form a chamber in which the cold air is accumulated. In the medium part of the refrigerating chamber 4, a shelf 16 provided with a vertical wall 17 is formed and together with the walls and the bottom form a chamber in which the cold air is accumulated. Chamber shelf 16 and door shelves 12 and 14 cooperate in mating interleaved relationship with one another, so that main shelf 16 mates with the door shelves and the door shelves thereby substantially cover or are covered by the chamber shelf 16 and the chamber shelf 16 and the door shelves 12 and 14 form chambers for receiving food stuff.

In order to improve the utilization of the inner volume of the refrigerating chamber 4, a curved shelf 18 with a vertical wall 19 is arranged in the upper corner, and a curved shelf 20 with a vertical wall 21 is arranged in the lower area, in which also the cold air is accumulated.

Since approximately half of all food products to be stored in a refrigerator are shifted to the radial shelves which are mounted on the inner surface of the doors 3 and 5, a supporting wheel 22 is arranged in the lower area of the lower door 5 to provide an additional support, and a strip 23 with an opening for fixing to the wall is provided at the upper inner side of the main body 1 of the refrigerator.

The operation of the inventive refrigerator is performed in the following manner:

To use the refrigerator the door 3 is for example opened and food products are taken from or placed onto the radial shelf 6. During this process the door 3 can be opened by an angle less than 90°. When it is necessary to replace or remove the products on the shelf delimited by the vertical wall 8 or from the a curved shelf 10, the door 3 is opened by an angle more than 90°. Since the radial shelf 6 is formed as a console attached to the door, it is recommended that lighter food products are placed on it, while the shelf delimited by the vertical wall 8 and the a curved shelf 10 can be loaded with heavier products. The refrigerating chamber 4 is utilized in the same way. The only difference is that the door 5 which carries two radial shelves 12 and 14 transmits a portion of its weight to the supporting wheel 22 which radially rolls on the floor when the door 5 is utilized. The strip 23 with the opening 24 is used to fix the main body 1 of the refrigerator to a wall.

As can be seen from the drawing the horizontal radial shelves of the door are guided on the vertical walls of the main body 1.

As can be also seen from the drawings, each of the vertical walls of each of the door shelves has substantially straight portions arranged to abut against a straight side wall of the main part and a curved portion arranged to abut against a curved portion of a respective vertical wall of a respective main shelf.

Each of the door walls is formed as a quarter of a circular disc.

It will be understood that each of the elements described above, or two or more together, may also find a useful application in other types of constructions differing from the types described above.

While the invention has been illustrated and described as embodied in a refrigerator, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A refrigerator, comprising a main body having an inner chamber having a rear and two side walls; a door moveable relative to said body between an open and a closed position, said main body having substantially horizontal main shelves, said door having substantially horizontal door shelves formed so that in a closed condition of the refrigerator the door shelves are turned into said main body, said door walls extending radially towards the rear of said main body chamber, said main shelves and said door shelves are provided with vertical walls which cooperate in mating interleaved relationship with one another so that one of said main shelves covers and is covered by a one of said mating door shelves and said door shelves with said vertical walls and one of said mating main shelves form chambers for receiving food stuff.

2. A refrigerator as defined in claim 1, wherein said radial horizontal shelves of said door are guided on said vertical walls of said main shelves during opening and closing of said door.

3. A refrigerator as defined in claim 1; and further comprising curved shelves arranged in said main body and having vertical walls cooperating with said vertical walls of said radial shelves of said door.

4. A refrigerator as defined in claim 1, wherein each of said vertical walls of each of said door shelves has substantially straight portions arranged to abut against a straight side wall of said main part and a curved portion arranged to abut against a curved portion of a respective vertical wall of a respective main shelf.

5. A refrigerator as defined in claim 1, wherein each of said door walls is formed as a quarter of a circular disc.

6. A refrigerator as defined in claim 1, wherein said vertical walls of said main shelves and said vertical walls of said door shelves are curved and complimentary to one another.

7. A refrigerator as defined in claim 1, wherein said door has a lower end provided with a supporting wheel which during opening and closing of said door rolls on a floor surface and the like.

8. A refrigerator as defined in claim 1, wherein said main body is provided with a strip attached to the rear thereof having an opening for attaching the main body to a wall by an attaching element extending through said opening.

* * * * *